United States Patent [19]

Menegatto

[11] 4,368,626

[45] Jan. 18, 1983

[54] CROCHET KNITTING MACHINE WITH WEFT BAR ADJUSTMENT AND GUIDE ASSEMBLY

[75] Inventor: Carlo Menegatto, Milan, Italy

[73] Assignee: O.M.M. Officine Meccaniche Menegatto S.p.A., Milan, Italy

[21] Appl. No.: 192,706

[22] Filed: Oct. 1, 1980

[30] Foreign Application Priority Data

Oct. 1, 1979 [IT] Italy ..... 26148 A/79

[51] Int. Cl.[3] ..... D04B 23/00

[52] U.S. Cl. ..... 66/203; 66/207

[58] Field of Search ..... 66/203, 207, 204, 85, 66/84

[56] References Cited

U.S. PATENT DOCUMENTS

| | | | |
|---|---|---|---|
| 3,303,670 | 2/1967 | Bassist | 66/207 |
| 4,092,838 | 6/1978 | Gangi | 66/214 |
| 4,145,897 | 3/1979 | Villa | 66/207 |

FOREIGN PATENT DOCUMENTS

| | | | |
|---|---|---|---|
| 548673 | 3/1977 | U.S.S.R. | 66/84 A |

*Primary Examiner*—Ronald Feldbaum

*Attorney, Agent, or Firm*—Fleit & Jacobson

[57] ABSTRACT

Crochet knitting machine with weft bar adjustment and guide assembly. The bars are carried on mobile supports, each one of which comprising a first device for adjusting the position along a vertical axis and, respectively, a second device for adjusting the position of the support along a horizontal axis parallel to the needles of the machine.

8 Claims, 4 Drawing Figures

CROCHET KNITTING MACHINE WITH WEFT BAR ADJUSTMENT AND GUIDE ASSEMBLY

BACKGROUND OF THE INVENTION

This invention concerns crochet knitting machines and in particular an assembly for adjusting and controlling the bars supporting the thread guides for guiding the weft threads, hereinafter referred to more simply as "weft bars".

A crochet knitting machine substantially comprises a bed of needles which are moved reciprocally and in synchronism with a set of thread guide needles for guiding the warp threads and respectively, with a set of thread guides for guiding the weft threads in order to permit the threads to knit together thereby forming the fabric with the desired pattern.

The weft guide thread guides are in general carried on horizontal parallel bars arranged in an arc disposition and guided lengthwise by lateral supports which in turn are moved vertically in such a way as to obtain a combined movement which permits a weft thread to knit together with the adjacent warp threads. The weft guide thread guides are placed upon different bars according to the type of pattern or work to be carried out, with the consequent need to adjust the position of the weft guide thread guides themselves with respect to the needles. This adjustment is currently carried out in a very approximate manner by shifting the thread guides cross-wise to the bars without however achieving a very precise adjustment and a positioning of the thread guides suitable for the various different requirements; and at times endangering the fastening of each individual thread guide to the bar.

SUMMARY OF THE INVENTION

One aim of this invention is therefore to provide a crochet-type textile machine provided with an adjusting assembly which permits accurate adjustment of the position of the weft-bar supports and consequently of the bars themselves.

A further aim of this invention is to provide a crochet knitting machine with an adjusting assembly, as mentioned above, which makes it possible to adjust the position of the bar supports independently, along two axes at right-angles to each other, laying on a perpendicular plane to the aforesaid weft bars.

By this invention a crochet knitting machine is provided of the type comprising a set of warp-guide thread guide needles and a set of weft-guide thread guides which are mobile, in combination with a bed of needles for producing the fabric, in which the weft-guide thread guides are carried by horizontal bars moved lengthwise by means of a system of control cams, such bars being held by vertically mobile lateral supports, wherein each weft bar support comprises a first device for adjusting the position along a vertical axis and respectively a second device for adjusting the position along a horizontal axis parallel to the aforementioned needles.

BRIEF DESCRIPTION OF THE DRAWINGS

These and further features of this invention will ensue from the following description, referring to the enclosed drawings, in which.

DESCRIPTION OF THE PREFERRED EMBODIMENT

Figure 1:
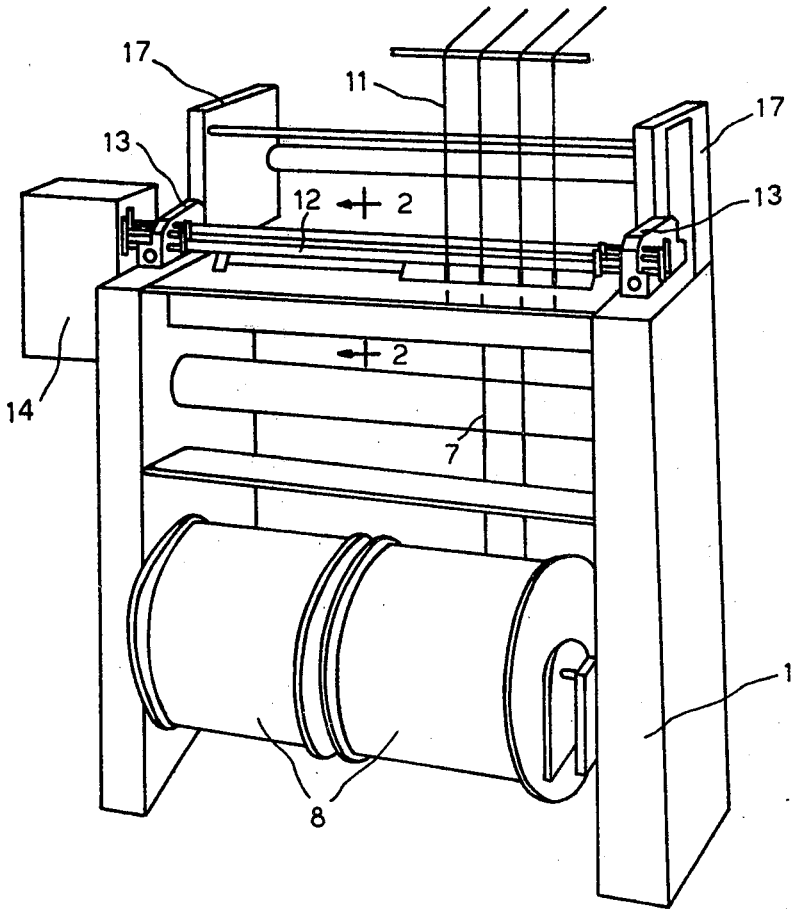
FIG. 1 is an outline view of a generic crochet knitting machine.
Figure 2:
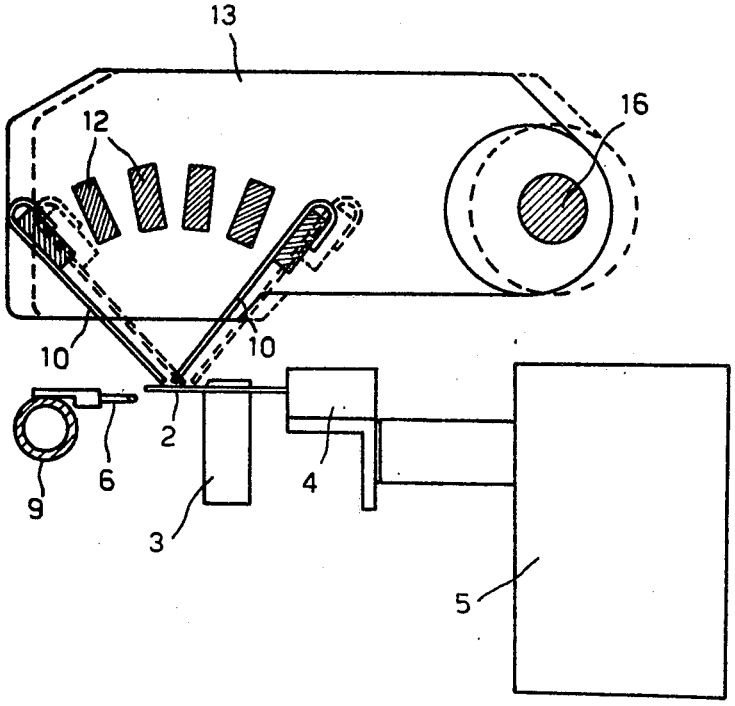
FIG. 2 shows a cross sectional view along the line 2—2 of FIG. 1.

FIGS. 1 and 2 show the basic components of a generic crochet knitting machine, comprising a structure 1 supporting a horizontal bed of needles 2 which are guided by a guiding bar 3 and held by bar 4 which is made to reciprocate by a control assembly indicated in outline by 5.

To the front of and parallel to the bed of needles 2 is a set of thread guide needles 6 for guiding the warp threads 7 fed by the beams 8; the thread guide needles 6 are held by a bar 9 which, in an already known manner, is made to rotate and to reciprocate along its axis in synchronism with the movement of the needles 2. Furthermore, 10 indicates the thread guides for guiding the weft threads 11 fed by suitable bobbins.

The weft-guide thread guides 10 face towards the needles and are hooked onto a set of horizontal bars 12 situated above the bed of needles 2, in an arc disposition as shown in FIG. 2.

The weft bars 12 are moved both vertically and lengthwise in synchronism with the needles 2 and the warp thread guides needles 6, to permit the threads to knit together thereby forming the fabric; consequently the weft bars 12 are held by lateral supports 13 mobile vertically and guided by the supports themselves during their lengthwise movement. The reciprocating lengthwise movement of the weft bars 12 is controlled by a control unit 14 (FIG. 1) of the cam type situated to the side of the machine. On the contrary, as shown in FIG. 3, the vertical reciprocating movement of the supports 13, and consequently of the entire set of weft bars 12, is supplied by a control unit 15 shown in outline.

Figure 3:
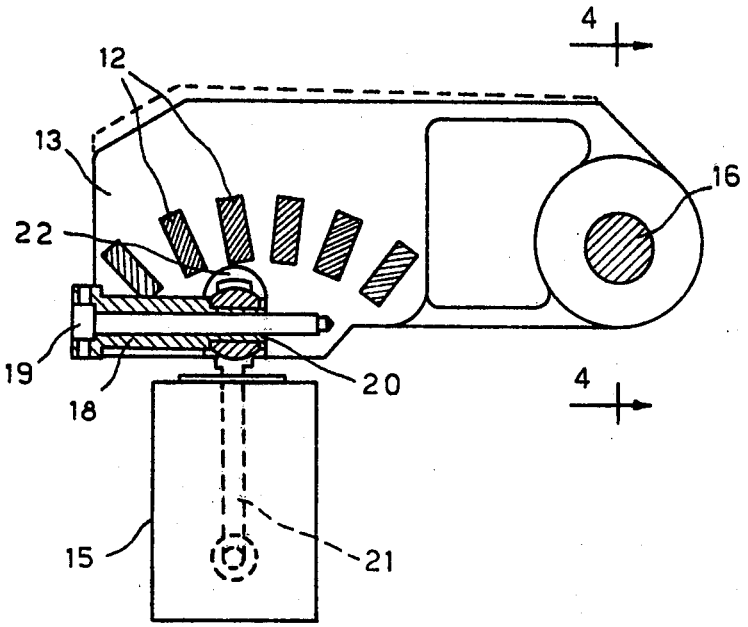
FIG. 3 shows a view of a weft-bar support, with a first device for adjusting the position of the support itself.
Figure 4:
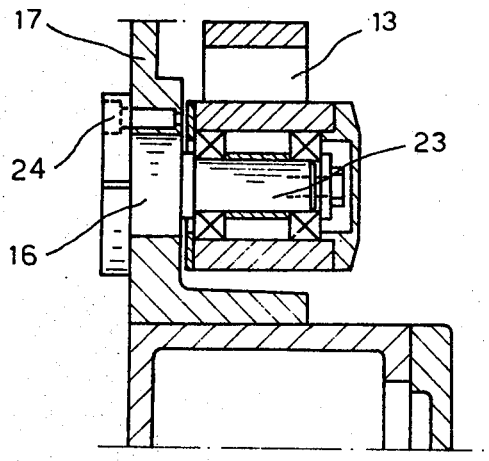
FIG. 4 shows a cross sectional view along the line 4—4 of FIG. 3, of the second device for adjusting the position of the weft-bar support.

As previously pointed out, in order to achieve a correct knitting together of the weft threads, it is necessary to adjust the position of the thread guides 10 both in a vertical direction as well as horizontally, parallely to the needles 2; this adjustment, as shown by the dotted lines in FIGS. 2 and 3, is obtained by providing the lateral supports of the weft bars with suitable devices for independent adjustment, of the cam or eccentric type, operating respectively in the two aforementioned directions.

The figures show the use of supports 13 oscillating along a horizontal axis, parallel to the bed of needles, defined by pins suitably fixed to the lateral uprights 17 of the structure of the machine. In particular, as shown in the cross section in FIG. 3, the vertical adjustment of the supports is achieved by means of a first eccentric pin 18, situated in a corresponding housing in the support 13, so as to enable it to rotate on an axis and to be fixed in an angular position, for example, by means of a screw 19 which is screwed through the pin and into the support itself. The pin 18 presents an eccentric extension 20 to which is articulated the upper end of a connecting rod 21 of the aforementioned control device 15. The big end of the connecting rod 21 is situated in correspondence with a cavity 22 in the support, which allows it a relative amount of movement; in fact, by loosening the screw 19, it is possible to rotate the pin 18 in order to make the extension 20 assume a different angular position and consequently a different eccentricity in a vertical direction. This results in a corresponding vertical shifting of the support 13 and of the weft bars 12.

Likewise to the latter, the horizontal adjustment, in the lengthwise direction of the needles 2 is achieved by acting upon the pivot pin 16 of each support; in fact each pin 16 presents an eccentric extension 23 to which the support 13 is pivoted. Therefore by rotating the pin 16 and securing it by means of the screw 24 in an angular position, it is possible to vary the eccentricity in a horizontal direction in order to adapt it to the various different requirements. Adjustment of the eccentric pins may be carried out in continuation, that is to say, by predetermined positions, it will be necessary in any case to provide suitable marks of reference for correct adjustment on both supports.

It will appear clearly evident from the foregoing description and enclosed drawings that a crochet-type textile machine is provided in which the supports of the bars which carry the thread guides for guiding the weft threads comprise devices which permit adjustment of the position of the supports themselves, both in a vertical and in a horizontal direction, lengthwise to the needles of the machine; whereby it is possible to adjust the position of the thread-guide thread guides in order to adapt them to the various different requirements.

What is claimed is:

1. Crochet knitting machine of the type comprising a set of warp-guide thread guide needles and a set of weft-guide thread guides which are mobile in combination with a bed of needles to make fabric, in which the weft-guide thread guides are carried on horizontal bars mobile lengthwise by means of a system of control cams, said bars being held by lateral support moved vertically, a control unit for controlling vertical movement of said supports, rod means for interconnecting said control unit with said supports, each weft bar support comprising a first device for adjusting the position along a vertical axis and respectively a second device for adjusting the position along a horizontal axis parallel to the aforementioned needles, said first device comprising means for adjusting the vertical relationship between said rod means, said control unit, and said supports, said second device being independent from said first device so that vertical adjustment is provided only by said first device and horizontal adjustment is provided only by said second device.

2. Crochet knitting machine as claimed in claim 1, in which said adjustment devices are of the cam type.

3. Crochet knitting machine as claimed in claim 1, in which the weft bar supports are pivoted from the rear on an axis parallel to the bars themselves, said vertical adjusting device comprising a pivot pin rotating on an axis, in a housing formed in the support, and means for securing the pin in different angular positions within the aforementioned housing, the pin presenting an eccentric extension to which the connecting rod of a device for controlling the vertical movement of the aforementioned supports is articulated.

4. Crochet knitting machine as claimed in claim 1, or claim 2, in which the weft bar supports are pivoted from the rear along an axis parallel to the bars themselves, the horizontal adjusting device comprising a pivot pin rotary supported on an axis parallel to that of rotation of the supports, said pin presenting an eccentric extension to which is pivoted a support of the aforementioned bars.

5. Crochet knitting machine comprising a set of warp-guide thread guide needles, a set of weft-guide thread guides, a bed of needles for knitting fabric, horizontal bars movable in a first direction lengthwise the needles for carrying said weft-guide thread guides, a system of control cam for controlling lengthwise movement of said bars, lateral supports movable in second directions perpendicular to the lengthwise direction of the needles for holding said bars, a control unit for controlling vertical movement of said supports, rod means for operatively associating said control unit with said supports, first means cooperable with respective ones of said lateral supports for adjusting the positions of the lateral supports along the second directions, and second means cooperable with respective ones of the lateral supports for adjusting the positions of the lateral supports along a horizontal axis parallel to the first direction, said first means and said second means being independently adjustable, said first means comprising means for adjusting only the vertical relationship between said control unit, said rod means, and said supports.

6. Crochet knitting machine as claimed in claim 1, further comprising a pin pivotally supporting said supports, said second device comprising means for moving said pin so as to adjust the horizontal position of said supports.

7. Crochet knitting machine of the type comprising a set of warp-guide thread guide needles and a set of weft-guide thread guides which are mobile in combination with a bed of needles to make fabric, in which the weft-guide thread guides are carried on horizontal bars mobile lengthwise by means of a system of control cams, said bars being held by lateral supports moved vertically, wherein each weft bar support comprises a first device for adjusting the position along a vertical axis and respectively a second device for adjusting the position along a horizontal axis parallel to the aforementioned needles, said weft bar supports being pivoted from the rear on an axis parallel to the bars themselves, said vertical adjusting device comprising a pivot pin rotating on an axis, in a housing formed in the support, and means for securing the pin in different angular positions within the aforementioned housing, the pin presenting an eccentric extension to which the connecting rod of a device for controlling the vertical movement of the aforementioned supports is articulated.

8. Crochet knitting machine of the type comprising a set of warp-guide thread guide needles and a set of weft-guide thread guides which are mobile in combination with a bed of needles to make fabric, in which the weft-guide thread guides are carried on horizontal bars mobile lengthwise by means of a system of control cams, said bars being held by lateral supports moved vertically, wherein each weft bar support comprises a first device for adjusting the position along a vertical axis and respectively a second device for adjusting the position along a horizontal axis parallel to the aforementioned needles, said weft bar supports being pivoted from the rear along an axis parallel to the bars themselves, the horizontal adjusting device comprising a pivot pin rotatably supported on an axis parallel to that of rotation of the supports, said pin presenting an eccentric extension to which is pivoted a support of the aforementioned bars.

* * * * *